US008355035B2

(12) United States Patent
Chow et al.

(10) Patent No.: US 8,355,035 B2
(45) Date of Patent: Jan. 15, 2013

(54) DIGITAL GRAVURE PRINTING WITH A PIXILATED PHOTOCONDUCTOR

(75) Inventors: Eugene M. Chow, Fremont, CA (US); JenPing Lu, Fremont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 478 days.

(21) Appl. No.: 12/697,109

(22) Filed: Jan. 29, 2010

(65) Prior Publication Data

US 2011/0185925 A1 Aug. 4, 2011

(51) Int. Cl.
*B41J 2/385* (2006.01)

(52) U.S. Cl. ..... 347/111

(58) Field of Classification Search ..... 347/111; 399/249

See application file for complete search history.

(56) References Cited

U.S. PATENT DOCUMENTS 3,801,315 A * 4/1974 Gundlach et al. ..... 430/49.1
3,974,554 A * 8/1976 Fantuzzo ..... 492/33
4,493,550 A 1/1985 Takekida
5,752,144 A * 5/1998 Mammino et al. ..... 399/249
5,983,058 A * 11/1999 Yamasaki et al. ..... 399/237
6,775,499 B2 8/2004 Pan et al.
2003/0156178 A1 8/2003 Lehmann

* cited by examiner

*Primary Examiner* — Laura Martin
*Assistant Examiner* — Tracey McMillion
(74) *Attorney, Agent, or Firm* — Jonathan A. Small

(57) ABSTRACT

A printing sub-system including same including a pixilated photoconductive member (such as a photobelt) is disclosed. Electrically isolated cells hold surface application material above the photoconductor. The surface application material is first charged. Charge on the surface application material in an individual cell may then be discharged by exposure of a region of the photoconductor proximate that cell to light from an optical addressing system. The surface application material is brought into proximity of an image receiving member such as paper, which is either charged or proximate a charge source. Charged surface application material in a cell may then be electrostatically transferred from the cell onto the image receiving member, while discharged surface application material remains in the cell. The subsystem may form a part of a complete printing system using many existing components. Among other advantages, viscous liquid surface application material may thereby be printed.

29 Claims, 16 Drawing Sheets

DIGITAL GRAVURE PRINTING WITH A PIXILATED PHOTOCONDUCTOR

BACKGROUND

The present disclosure is related to image marking methods and apparatus, and more specifically to methods and apparatus for electrophotographic gravure printing.

Electrophotography (or Xerography) is a well-known printing technology. In one common form of electrophotography a charged receptor surface is exposed to an image to be printed. The charge on the receptor surface is modified (e.g., discharged) where it is exposed to the image. The different charge states (e.g., charged or discharged) are used to selectively retain a charged pigment material (e.g., ink or toner). For example, where the receptor surface is exposed to light and thereby discharged no pigment material remains. The pigment material remaining on the receptor surface is transferred to a desired substrate, such as paper, where it may be fused or dried on the substrate.

Generally, electrophotographic systems utilize a dry, powdered pigment material referred to as a toner. These systems generally require that the substrate be charged, and that the toner be fused to the substrate, often by heating the substrate, after transferring the toner from the receptor surface to the substrate. There is, however, a desire for methods and systems for printing with different types of surface application materials (such as inks, adhesives, surface finish treatments, protective coatings, electrically conductive regions, etc.) and on a wider variety of substrates.

For example, one common family of alternative pigment material are liquid-based inks, such as used in ink-jet and other forms of printing well-known today. In many modern printing applications, the inks used are comprised of charged pigment particles suspended in a solvent carrier.

Ink-based printing systems require relatively low viscosity inks. The viscosity of the ink affects the printing throughput, the function of transferring to and fusing the image on a substrate, the internal operations of the printing system, the cleaning of the printing system and so forth. Thus, these systems generally are limited to using inks with a viscosity of for example less than 100 centipoise (cp). However, there are many applications for which a higher viscosity ink is advantageous, such as permitting the use of a wider variety of inks and substrates, reduced cost, etc.

A number of printing techniques accommodate high viscosity inks. Gravure printing is one example of a well-known printing technology that can accommodate a relatively wider range of ink viscosities. According to this technique, an image carrier (most often a drum) is provided with a pattern of relatively very small recessed areas or cells. An ink is spread over the image carrier such that ink is retained in the cells, but not on the lands between the cells. An image-receiving substrate is brought into pressured contact with the ink-bearing plate or drum. The ink wicks out of the cells and onto the substrate, where it is dried, thereby imparting a marking onto the substrate. Gravure printing can accommodate higher viscosity inks, but the image is not variable from printing to printing—the gravure pattern is a permanent part of the image carrier.

The present disclosure is focused on a combination of electrophotography and gravure printing to obtain digital (or variable) gravure printing. There have been efforts to combine these different printing technologies. For example, WO 91/15813 (Swidler) discloses an electrostatic image transfer system by which the negative or reverse of a desired image is first exposed onto the surface of a photoreceptor, then that image is transferred to a toner roller, where the image is reversed to create the desired image on the toner roller. This image on the toner roller may then be transferred to a substrate and fused.

Another reference is U.S. Pat. No. 3,801,315. According to this reference, a gravure member is used to form an image on a substrate. The gravure member includes a number of evenly spaced cells with interstitial surface lands. A photoconductor is formed on the surface lands only (i.e., no photoconductive material within the cells). Pigment material is deposited within the cells. The photoconductor is exposed to an image, and in the regions of exposure the charge on the photoconductor is dissipated. In cells adjacent charged lands, the pigment material forms a concave meniscus, and in cells adjacent discharged lands the pigment material forms a convex meniscus, due to the electric field effects on the surface tension of the pigment material. The image is then transferred from the gravure member to a conductively backed image-receiving web brought into contact with the gravure member. Where there is a conductive difference between land and conductive backing, and the pigment material is convex within a cell, the pigment material in the cell is transferred to the receiving web. Where the meniscus of the pigment material is concave within a cell and there is no conductive difference between land and web backing, no pigment material is transferred. The image may then be transferred from the web to a substrate. However, due to the meniscus effects, and the fact that electrostatics are required to pull the pigment material out of the cells and onto the receiving web, the pigment material must be of a relatively low viscosity. Furthermore, the reference teaches using a separate photoreceptor and gravure member, requiring cleaning of the ink off of the photoreceptor for every printing pass.

Another application of electrophotography to a gravure-like process is disclosed in U.S. Pat. No. 4,493,550. According to this reference, pigment material is disposed in cells and provided with a negative charge. A positively charged photoreceptor is image-wise exposed such that certain regions are discharged and others retain the positive charge. The photoreceptor and the pigment containing cells are brought proximate one another such that the opposite charge therebetween causes the pigment material to transfer from the cells to the photoreceptor where the photoreceptor retains the positive charge but not where it is discharged. The pigment on the photoreceptor may then be transferred to substrate. Again, however, the pigment material must be of a relatively low viscosity for the electrostatic force to be sufficient to pull the pigment material from the cell to the photoreceptor. This reference also teaches using a separate photoreceptor and gravure member, requiring cleaning of the ink off of the photoreceptor for every printing pass.

An improved system and method to perform variable data printing of viscous inks would permit digital production printing in, among other fields, the commercial graphic arts and packaging markets. The ability to use viscous liquid inks would provide numerous advantages, including use of higher density/viscosity pigment, lower fixing energy (no fusing), larger substrate latitude, and lower ink spreading or dot gain. Furthermore, the ability to perform variable data printing of other surface application materials such as other forms of pigments, adhesives, surface finish treatments, protective coatings, electrically conductive regions, etc. would expand existing markets and provide new opportunities for printing materials. In general, limits on exiting printing techniques such as ink-jet printing imposed by the viscosity of printing materials can be addressed and overcome.

SUMMARY

Accordingly, the present disclosure is directed to a system and method for variable data printing permitting use of a wide variety of surface application materials, and in particular materials having a relatively high viscosity. The system and method are a hybrid form of electrophotography and gravure printing.

According to one aspect of the disclosure, a printing system uses a pixilated photoreceptor (such as a belt, referred to herein as a photobelt). A plurality of electrically isolated cells is formed on the photoreceptor. The cells are sized and disposed such that they may hold a liquid surface application material (such as an ink), essentially forming a digital imaging gravure. The cells are partially filled with the surface application material. The cells are each electrically isolated from one another and either a portion of the cells or the surface application material may be electrically charged. Charging may either be uniform across all cells or image-wise pattern charged (i.e., on a cell-by-cell or region-by-region basis). Cells are then image-wise discharged by optical exposure, for example by a laser raster scanning subsystem, LED array, etc. A substrate is brought into close proximity to the photoreceptor, and a bias associated with the substrates effectively pulls charged liquid out of the cells and onto the substrate. The liquid only has to travel a short distance (e.g., several micrometers), and sufficient charge differentials between substrate and liquid may be established so that higher viscosity liquids can be printed than possible by standard electrophotography.

According to another aspect of the present disclosure, a charge transfer to or from the charged liquid (e.g., connection to ground) may be accomplished, or assisted, by shorting electrodes provided at the base of each cell. The shorting electrodes provide a low electrical impedance path from the ink within the cell to the photoreceptor. Alternatively, each cell may be provided with a conductive sidewall(s) which may be connected to allow the charged liquid to be discharged on a cell-by-cell basis.

According to yet another aspect of the present disclosure the photoreceptor is optically transparent. The cells may then be optically addressed from the backside of the photoreceptor—the side opposite that on which the cells are formed and filled with liquid.

The above is a summary of a number of the unique aspects, features, and advantages of the present disclosure. However, this summary is not exhaustive. Thus, these and other aspects, features, and advantages of the present disclosure will become more apparent from the following detailed description and the appended drawings, when considered in light of the claims provided herein.

BRIEF DESCRIPTION OF THE DRAWINGS

In the drawings appended hereto like reference numerals denote like elements between the various drawings. While illustrative, the drawings are not drawn to scale. In the drawings.

DETAILED DESCRIPTION

We initially point out that description of well-known starting materials, processing techniques, components, equipment and other well-known details are merely summarized or are omitted so as not to unnecessarily obscure the details of the present disclosure. Thus, where details are otherwise well known, we leave it to the application of the present disclosure to suggest or dictate choices relating to those details.

Figure 1:
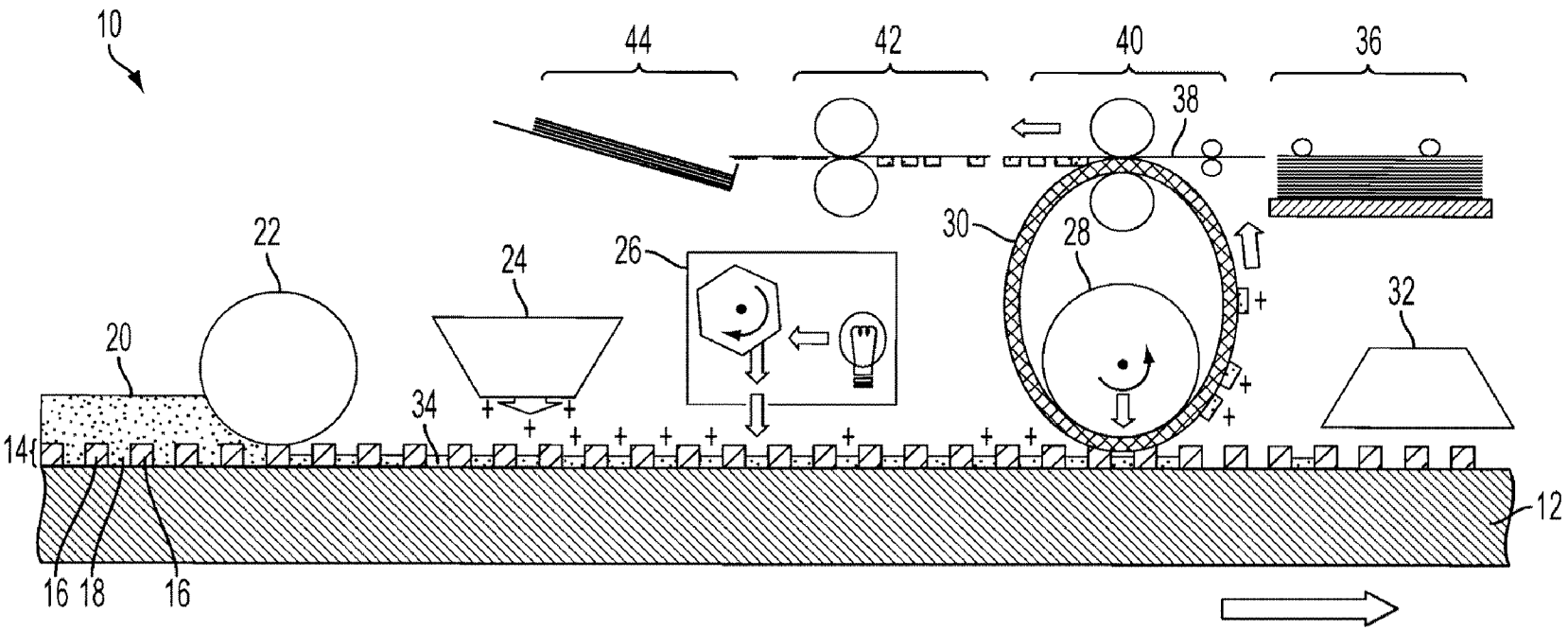
FIG. 1 is a schematic illustration of a system for the printing of viscous liquid liquids using a pixilated photobelt according to one embodiment of the present disclosure.

With reference to FIG. 1, there is shown therein a system 10 for the printing of viscous liquids. The components of system 10 are first described. The method by which system 10 imparts an image onto a substrate is described thereafter.

System 10 comprises a photoreceptor, which it this embodiment is photobelt 12, although the form of the photoreceptor is not a limitation to the scope of the present disclosure. An electrically insulative spacer layer 14 is formed over one surface of photobelt 12, then patterned by one of a variety of known methods to form an array of lands 16 which define physically isolated cells 18. Accordingly, we refer to the patterned spacer layer as being "pixilated." According to this first embodiment, the material comprising electrically insulative spacer layer 14 should have multiple properties, including: at least partly transparent to an optical addressing system, physically and chemically robust in the presence of the printed liquid and metering system, and laterally electrically isolating. The lateral electrical isolation should maintain the charge for a time longer than the time required to complete the image development.

A liquid reservoir 20 containing a surface application material such as ink, adhesive, surface finish treatment, protective coating, electrically conductive material, etc. and metering system 22 provide a controlled amount of liquid surface application material for each cell, as described further below. While ink is one type of surface application material applicable to in the embodiments described below, many other types of liquid-based electrostatically chargeable materials may also be used. Examples of other surface application materials include liquid toners, adhesives, surface finish treatments, protective coatings, electrically conductive materials, and so on. Furthermore, while the present disclosure addresses the difficulties associated with printing of viscous materials, the material employed in the processes and systems disclosed herein need not have a high viscosity. Given that the range of useful materials is so large, for brevity we refer to the surface application material generally as a liquid. Accordingly, the type of liquid does not in and of itself limit the scope of the present description.

A mechanism, such as a screened corona charging device 24, is provided for blanket charging of the liquid within the cells. An optical addressing system 26 such as a laser raster output scanner (shown by way of example only), LED bar, etc. 26 is provide for optically addressing each cell in a cell-by-cell and row-by-row, raster fashion. A biased conductive impression roller 28 applies pressure to a substrate such as a moving image receiving web 30. While discharged liquid may remain in situ until a next bulk charging/selective discharging/developing cycle, an optional cleaning station 32 may be provided to remove liquid remaining in any cells after the image transfer to image receiving web 30.

Additional elements which may form part of a complete printing device employing system 10 include a source 36 of a substrate 38 such as sheet paper (other substrates such as roll paper, non-paper substrates, etc. may also be employed), a developer portion 40 at which the liquid is transferred from image receiving web 30 to substrate 38, thereby developing the image thereon, a fixer portion 42 for curing evaporating, melting or otherwise fixing the liquid to substrate 38, and an outfeed portion 44 for receiving the substrate with the desired image printed and fixed thereon. It will be appreciated that each of these elements are optional and that few or lesser elements may be included in apparatus taking advantage of the present disclosure. Furthermore, while the above describes an apparatus that may form an image on a paper substrate, the present disclosure contemplates forming images on many other forms of substrates, and indeed one significant advantage of the present disclosure is the ability for form an image on a wider variety of substrates than present systems currently permit.

According to the method disclosed herein, liquid 34 from reservoir 20 is loaded into the cells of the pixilated photoreceptor 12. Metering system 22 removes excess liquid such that the level of liquid 34 in each cell is relatively uniform, and preferably below the top surface of lands 16. The metering system can consist of blades or rollers (see, e.g., U.S. Application for Letters Patent Ser. No. 12/566,518, titled "Anilox Metering System for Electrographic Printing", which is hereby incorporated by reference). It's also possible that the liquid self-loads into the cells, through surface energy control (such as a low energy, liquid repelling gravure land 16). A blanket charge is applied to the liquid 34 in all cells as they pass by corona charging device 24. In this embodiment, the charge may be positive, but polarities can be reversed in appropriate applications of the present disclosure.

Individual cells are then exposed to light from optical addressing system 26 based on an image to be printed, developing the image onto the pixilated photoreceptor 12. The charge on liquid 34 within a cell 18 will dissipate when a local region of the photobelt 12 is exposed to light. The light penetrates the gravure cell (as the liquid may often be at least partly opaque) and is incident on a photoreceptive surface of photobelt 12 therebelow. The exposed region of the photobelt 12 is now conductive and can discharge liquid in cells in contact with the exposed region thereof. If needed to increase the discharge speed, a conducting pad, conductive sidewall, or other similar element (discussed further below) can connect each liquid cell to the edge of the photoreceptor under the gravure cell walls. The liquid conductivity should be high enough so that this electrostatic discharge is relatively rapid. The liquid 34 will remain charged if not exposed to light by optical addressing system 26. Accordingly, liquid in the cells to be subsequently printed remains charged, while the liquid in the non-image cells becomes discharged. It will be appreciated that either lands 16 or liquid 34 must be at least partially transparent to the wavelength of light from optical addressing system 26. In the embodiment illustrated in FIG. 1, the ultimately desired image is developed onto the pixilated photoreceptor 12, although in other embodiments a reverse image may be developed on photoreceptor 12.

The moving image receiving web 30 is in physical contact with the top of the lands 16, so that it is in close proximity to, although not physically touching liquid 34 in cells 18. Impression roller 28 performs two functions at this point. First, it applies a pressure to image receiving web 30 so that the later is brought against lands 16. Second, impression roller 28 is biased so that there is an electrostatic attraction drawing charged liquid 34 towards its surface. This attraction causes liquid 34 to exit its cell 18 and become applied to the image receiving web 30 disposed between liquid 34 and the charged impression roller 28. Uncharged liquid 34 is not electrostatically attracted towards impression roller 28, and therefore remains within its cell 18. This is seen as a gap in the liquid on image receiving web 30.

The individual spots of liquid 34 applied to the surface of image receiving web 30 are constrained in size in one or more of a variety of ways. First, there is a fixed volume of liquid within the cell. This limits any dispersion on the surface of image receiving web 30. Second, an important aspect of the present disclosure is that it permits the use of relatively high viscosity liquids. This high viscosity further limits spreading on the image receiving web 30. Third, image receiving web 30 may be formed of a non-wetting material, thereby further still limiting the dispersion of liquid 34 on the surface of image receiving web 30. Finally, image receiving web 30 is in physical contact with the upper surfaces of lands 16. The sidewalls thereof define not only cell 18, but also essentially a lateral form at the surface of image receiving web 30 which physically may further constrain the dispersion of liquid 34 on the surface of image receiving web 30.

Figure 2:
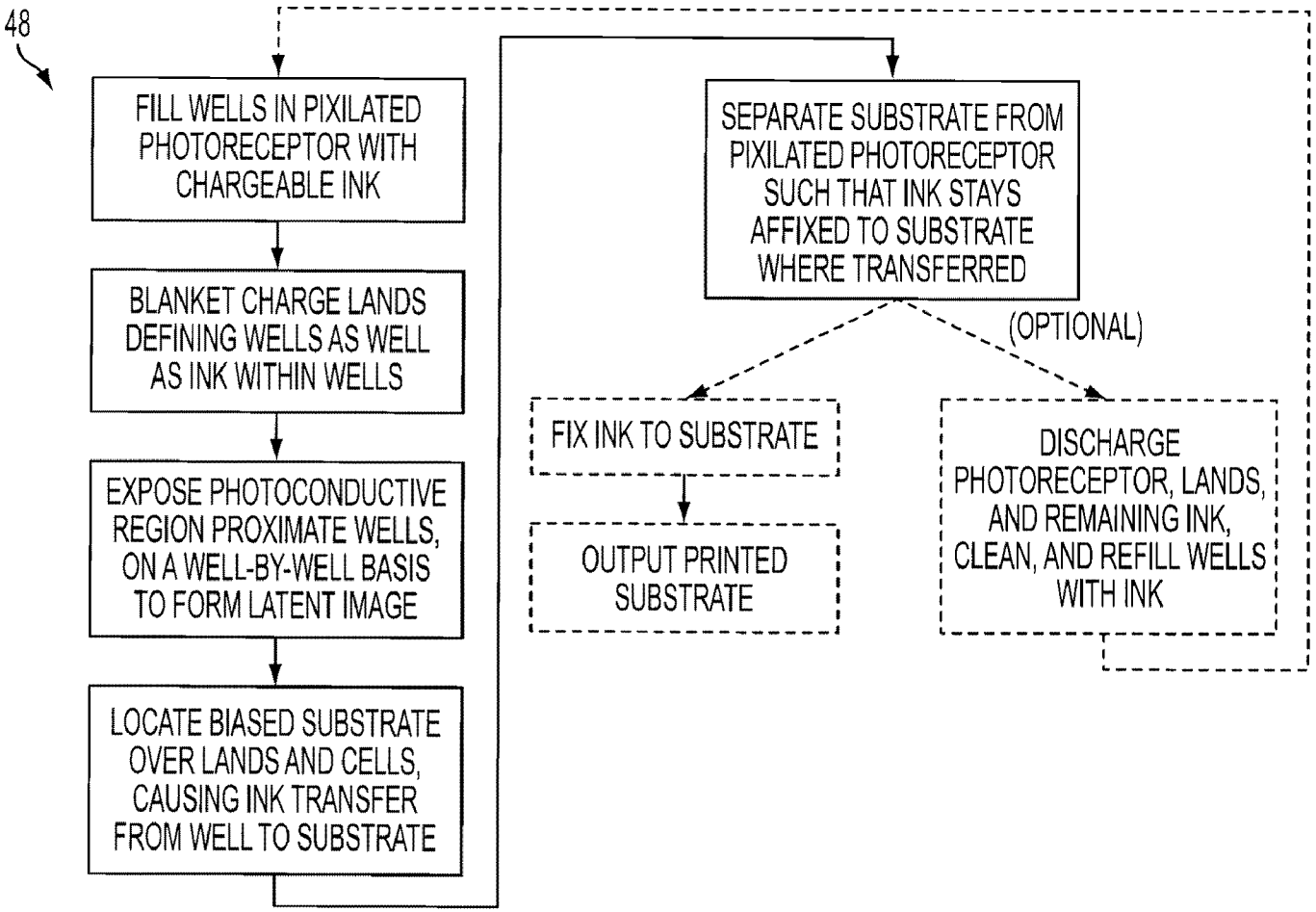
FIG. 2 is a flow diagram illustrating steps for the printing of viscous liquids using a pixilated photobelt according to one embodiment of the present disclosure.

The image developed onto image receiving web 30 may then be applied to a substrate, such as sheet paper 38, non-paper substrates such as plastic, non-absorbing substrates, etc. Additional steps required to deliver the substrate for development at 36, fixing the image onto the substrate at 42, and handling the final printed substrate at 44 may also optionally be handled at this point. A complete method 48 as described above is illustrated in FIG. 2, where steps shown in dashed outline are optional.

Figure 3A:
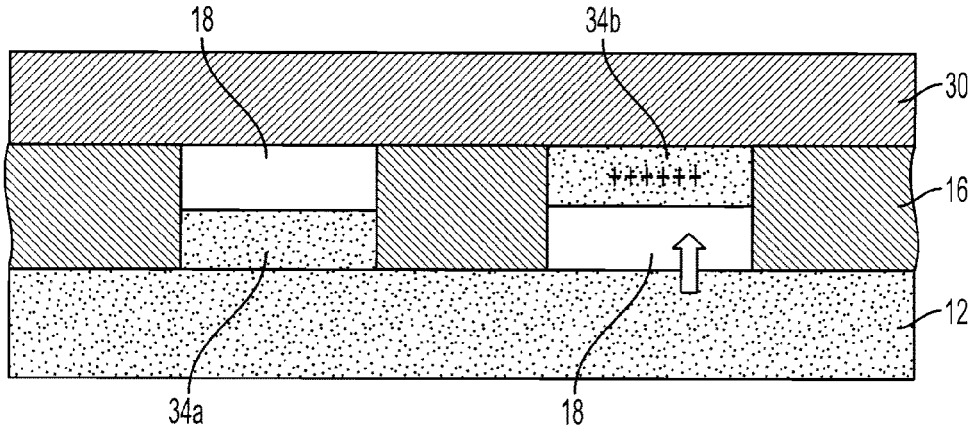
FIGS. 3A and 3B are a close-up views of two cells of the system for the printing of viscous liquids using a pixilated photobelt illustrated in FIG. 1.
Figure 3B:
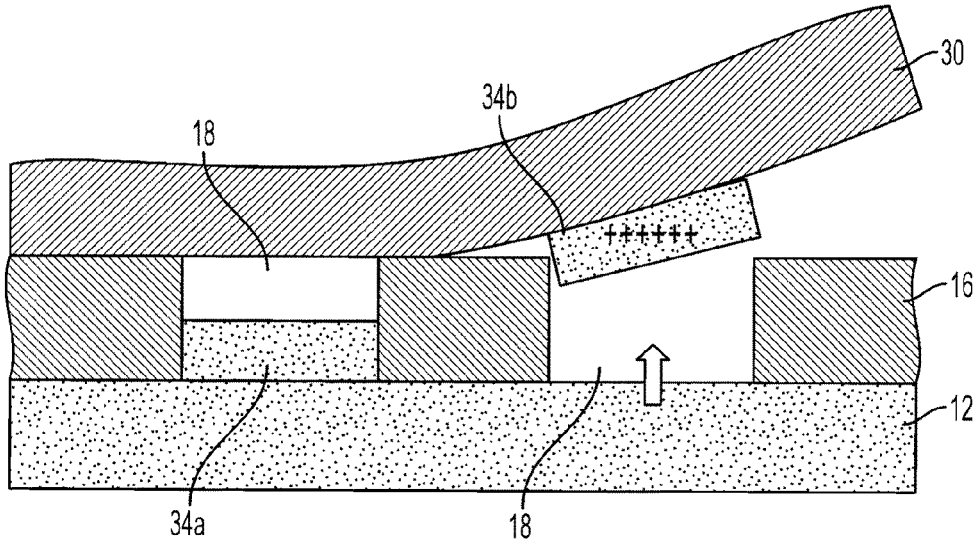
Figure 4:
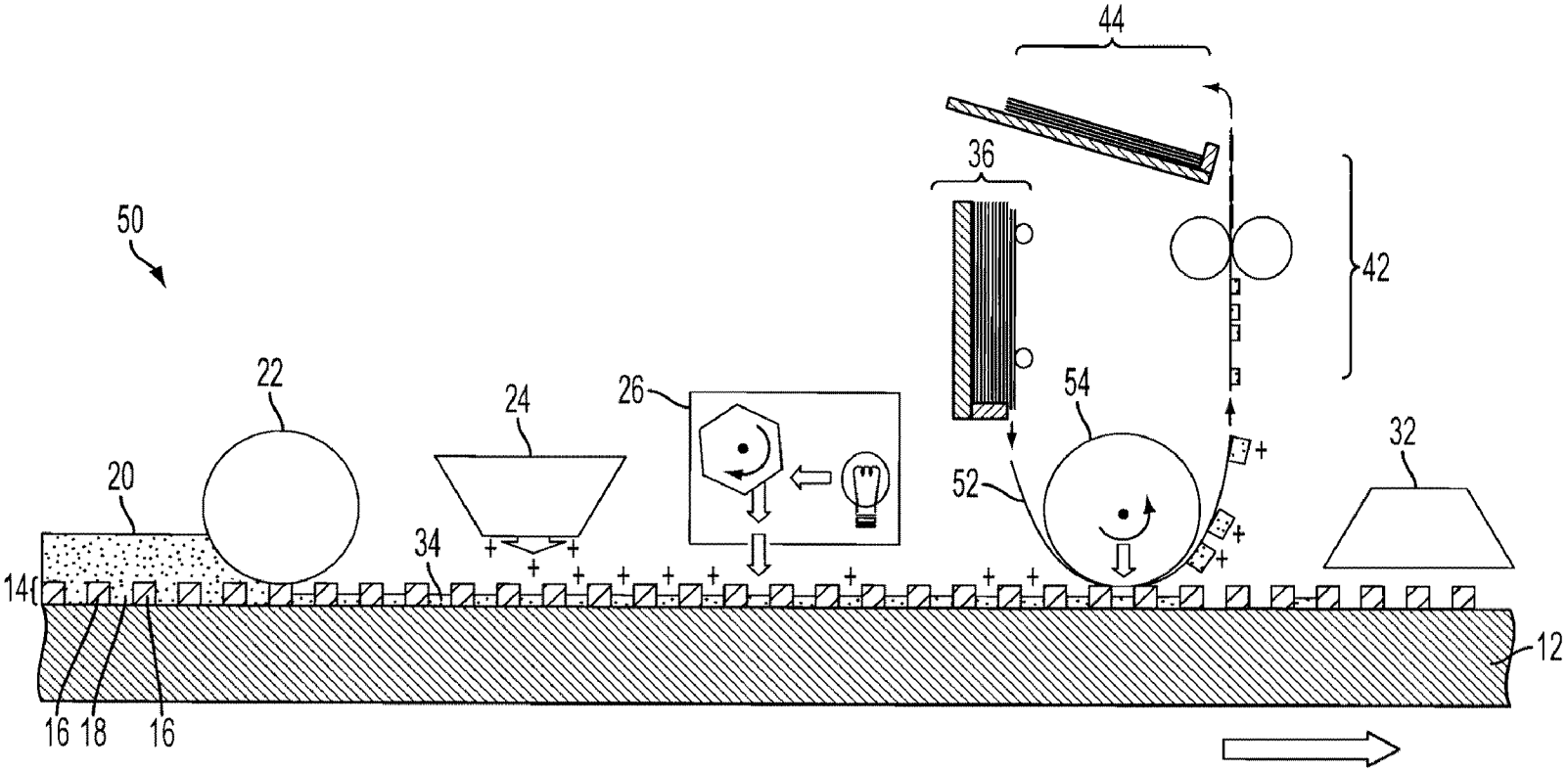
FIG. 4 is a schematic illustration of a system for the printing of viscous liquids using a pixilated photobelt according to another embodiment of the present disclosure.

With reference to FIGS. 3 and 4, which are magnified views of the development nip at successive stages of the image transfer process disclosed herein, it can be seen that discharged liquid 34*a* is not attracted to the surface of biased image receiving web 30, while charged liquid 34*b* is attracted to the surface of biased image receiving web 30. As the paths of photobelt 12 and image receiving web 30 diverge, liquid

34*b* electrostatically attracted to image receiving web 30 remains on the surface of web 30, while discharged liquid 34*a* remains in cell 18.

An alternative embodiment 50 is illustrated in FIG. 4. In place of using an image transfer web 30, a substrate 52 is brought directly into close proximity with lands 16 on photobelt 12. The electrical bias behind the substrate, provided by a charged roller 54, provides a counter electrode to attract the charged liquid 34.

In all embodiments, contact, or near contact is required, so that the electrostatic force needs only to move liquid 34 enough to wet the substrate (similar to electrostatic assist in gravure). The liquids (50-1000 cp typically) are too viscous to electrostatically move across a large gap. The walls of cells 18 serve the important role of keeping uncharged liquid from touching the substrate and unintentionally transferring to the substrate and the undesirable printing artifacts caused thereby.

It will be appreciated that while the above embodiments have been described in terms of a charged liquid being attracted to an oppositely charged substrate, it may be that the charged portions of the liquid remain in the cells while the uncharged liquid (as used here, also including discharged liquid) is transferred to the substrate. Such an embodiment may be realized by an attractive force retaining the liquid in the cells, by changing the magnitude or sign of the charge on the bias (i.e., the same sign as the charge on the liquid), or other attraction mechanism favoring transfer of the uncharged liquid to the substrate.

Figure 5A:
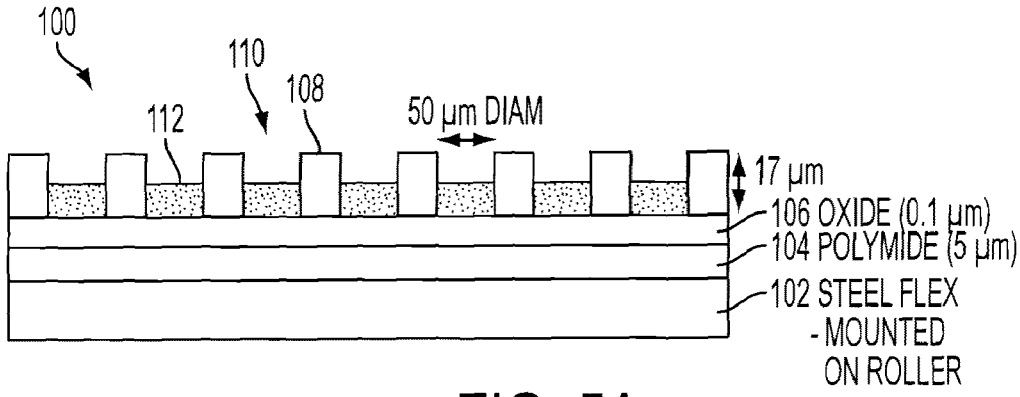
FIGS. 5A and 5B are side elevation and top plan view, respectively, of an apparatus used to evaluate certain aspects of the system and method for the printing of viscous liquids according to an embodiment of the present disclosure.
Figure 5B:
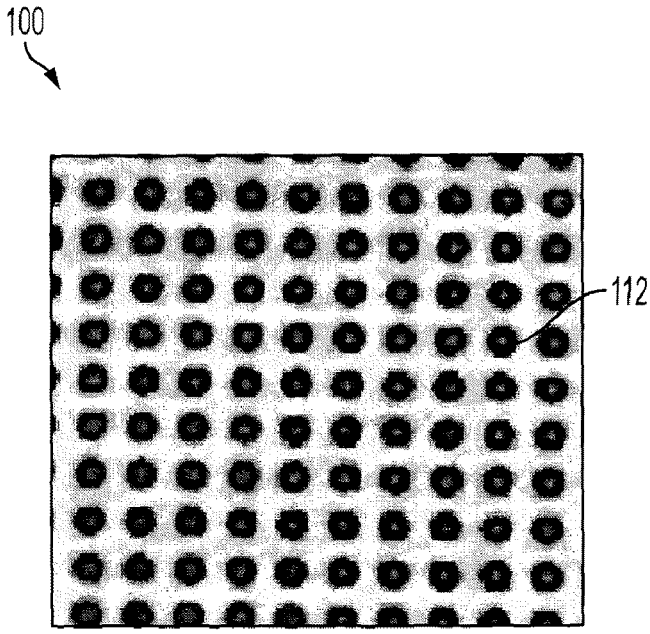

In one trial of the aforementioned image development technique, ink was loaded into cells (without an underlying photoreceptor), and image-wise charging and transfer of the ink was performed. With reference to FIG. 5A, a structure 100 included a flexible plate 102, such as sheet steel, over which was formed a polymide layer 104 approximately 5 micrometers (μm) in height and an oxide film 106 approximately 1 μm in height. A pixilated pattern of lands 108 approximately 17 μm in height was then formed in a second polyimide layer, creating roughly circular cells 110 approximately 50 μm in diameter. The polyimide lands 108 were fluorinated in a plasma to lower the surface energy, relative to the high surface energy oxide film 106. Structure 100 was dipped in a liquid ink (1000 cp UV flexographic ink) and the cells 110 automatically loaded about half-full of ink 112. FIG. 5B is a microphotograph of the actual loaded structure 100.

Figure 6:
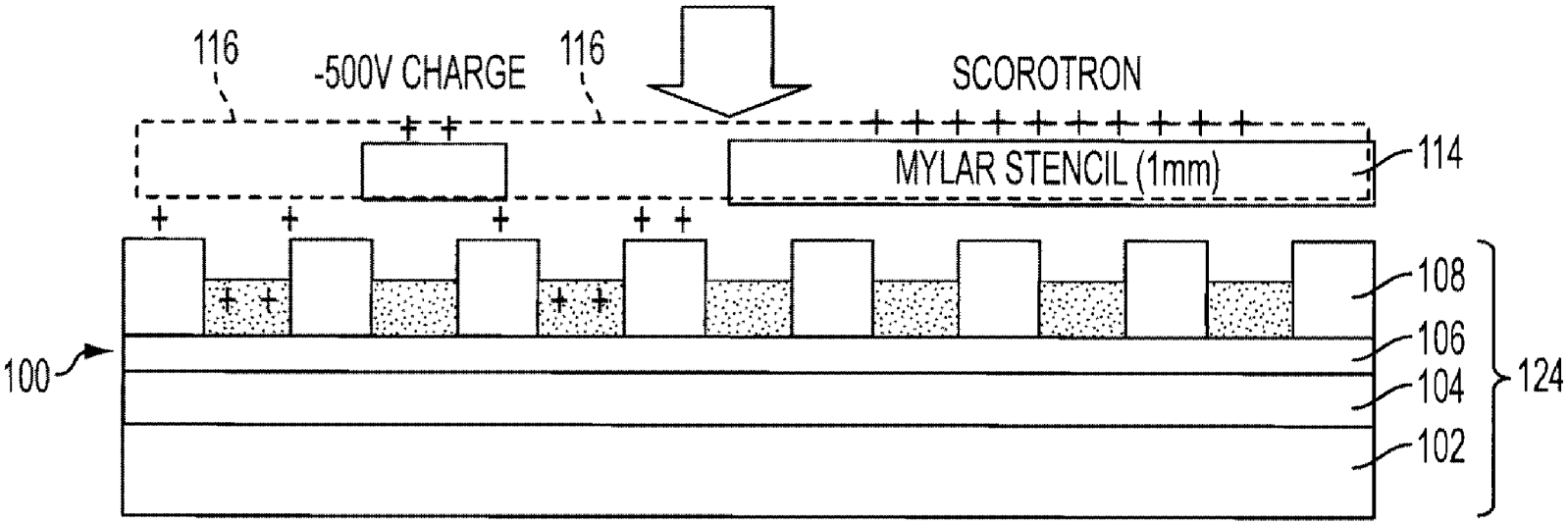
FIG. 6 is a side elevation of the apparatus of FIGS. 5A and 5B showing a stencil used for exposure in place of an optical scanning system.

With reference to FIG. 6, the ink was then charged with a corona charging device (not shown in FIG. 6) through stencil mask 114. Stencil mask 114 was a Mylar film approximately 1 millimeter (mm) in thickness. The mask formed the text "Xerox" (not shown in FIG. 6). Thus, in this embodiment the ink was not first uniformly charged and then selectively discharged, but rather selectively charged through openings 116 in mask 114.

Figure 7:
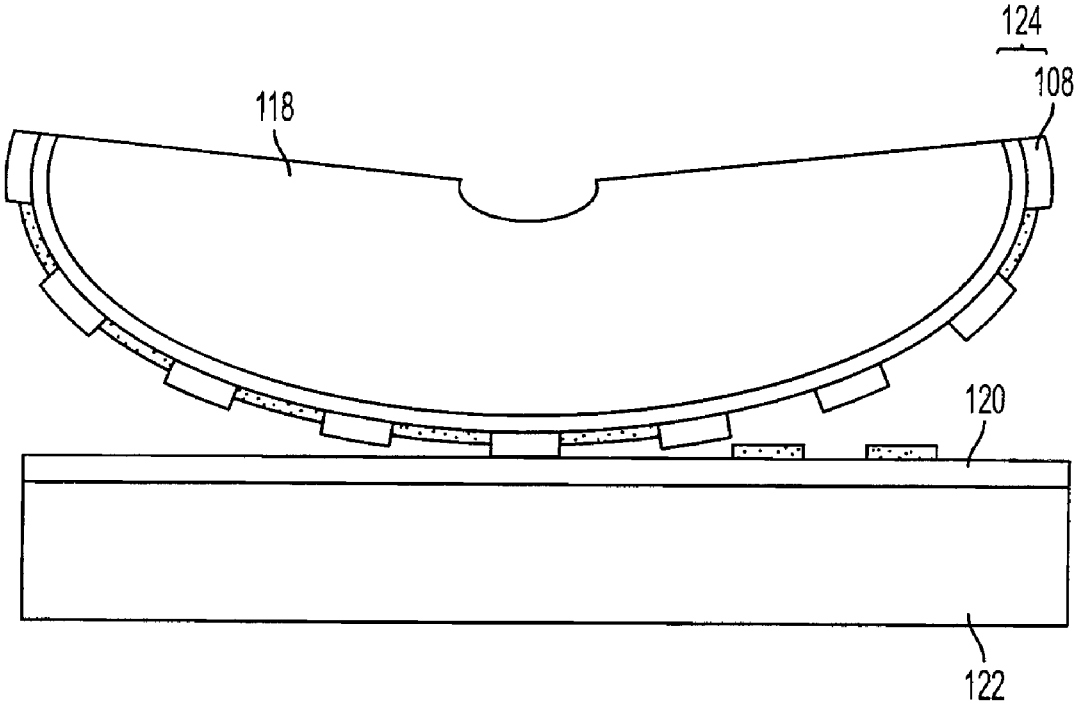
FIG. 7 is a side elevation view of the apparatus of FIGS. 5A and 5B showing the development process of a latent image onto a substrate.
Figure 8A:
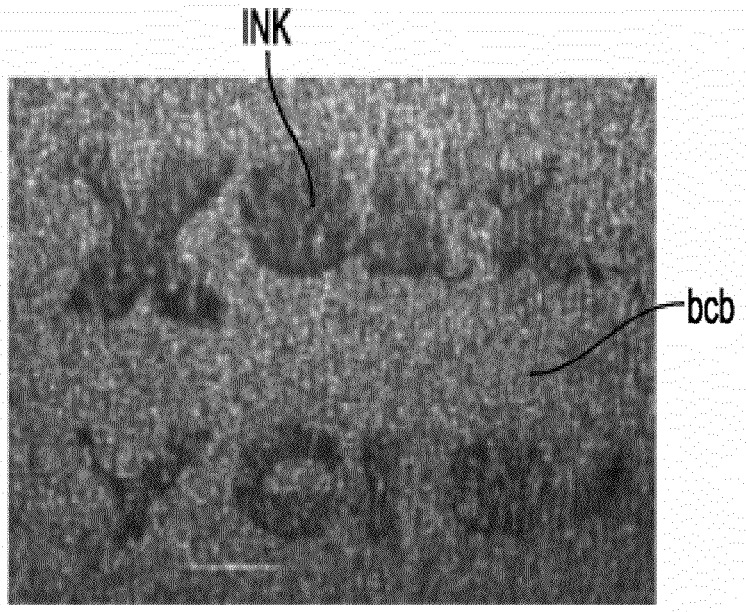
FIGS. 8A and 8B are microphotographs showing the printed image, and the latent, reverse image, respectively, in the cell plate structure of FIGS. 5A and 5B.
Figure 8B:
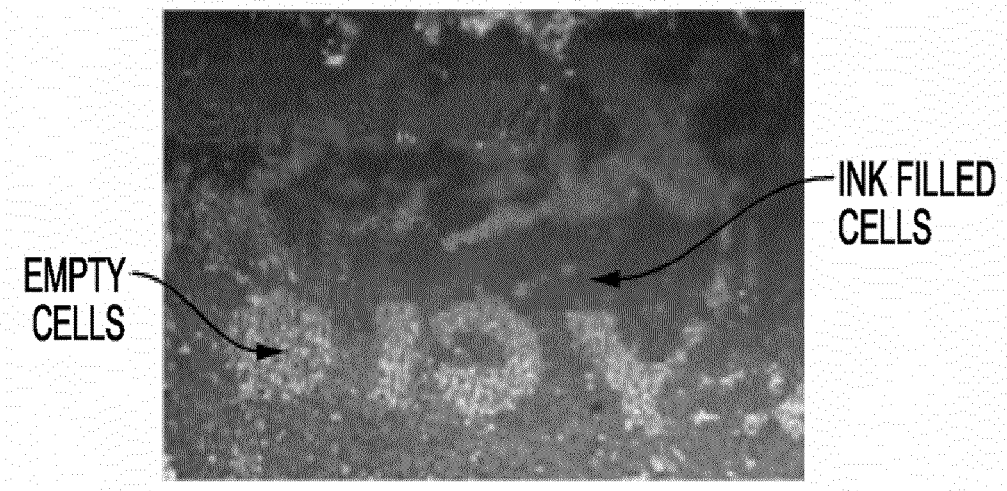

With reference to FIG. 7, the inked cell plate structure 100 was next curved into a convex cylindrical cross section over a rubber roller 118, and rolled against a dielectric layer 120, such as divinyl siloxane benzocyclobutene (BCB, trade name: Cyclotene 3022, produced by Dow Chemical Co.) or other dielectric (e.g., polyimides) over a rigid substrate 122 such as a rigid flat steel plate. An ink image in the pattern of mask 114 selectively transferred to the dielectric layer 120. FIG. 8A shows the printed image, and FIG. 8B shows the latent, reverse image in the cell plate structure 100.

Thus, the present disclosure teaches a simplified gravure digital image development (printing) device. In particular the gravure device employs a pixilated photoconductor as part of the printing system and method. Part count is reduced, as is the need for specialized components, apart from the pixilated photoconductor, as compared to known systems and methods. Cleaning requirements are reduced compared to many various prior approaches to electrostatic proximity printing. Furthermore, the present disclosure scales to higher resolution, does not require expensive toner inks, and is conducive to organic photoreceptors, and thus belt architectures. Belt architectures are important because they can be used to provide long development nips; important for fast printing or more viscous liquids.

Figure 9A:
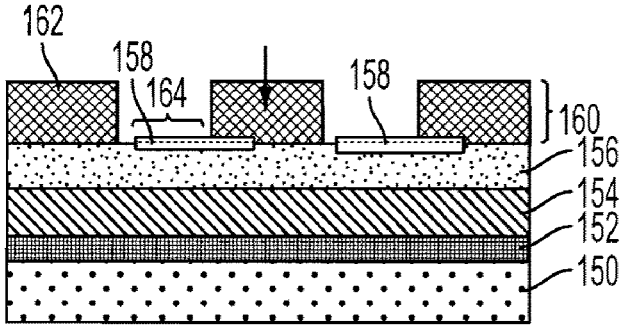
FIGS. 9A through 9F are side elevation views of a pixilated photoreceptor including shorting electrodes according to one aspect of the present disclosure.

In one variation of the above disclosed embodiments, shorting electrodes may be provided under the liquid and within the cells to increase discharge speed. With reference to FIGS. 9A-9F, a marking process employing such an arrangement is shown. FIG. 9A shows a carrier 150 (such as a belt portion of the photoreceptor) on which is formed a conductor layer 152, a charge generation layer 154, and a transport layer 156. In the various embodiments herein, the carrier 150, conductor 152, charge generation layer 154 and transport layer 156 may be discrete layers, or an integrated photoreceptive structure (i.e., having integrated or separate charge generation and transport layer are one in the same). Shorting electrodes 158 are formed over transport layer 156. An electrically insulative spacer layer 160 is formed over shorting electrodes 158 and exposed regions of transport layer 156. Insulative spacer layer 160 does not have to cover all of the exposed transport layer 156. In fact, it is advantageous if shorting electrodes 158 are kept relatively small to maximize resolution and reduces cross talk. Spacer layer 160 is patterned by one of a variety of known methods to form an array of lands 162 which define physically isolated cells 164. Notably, at least a portion of shorting electrodes 158 are exposed within cells 164.

Figure 9B:
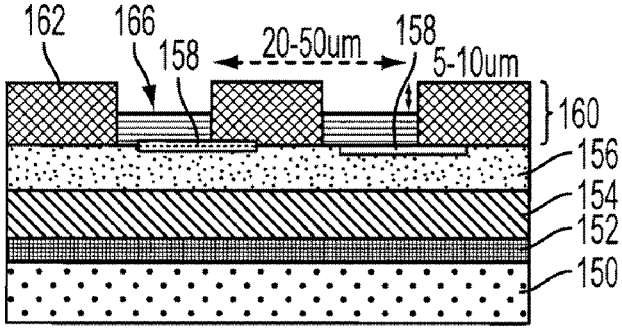
Figure 9C:
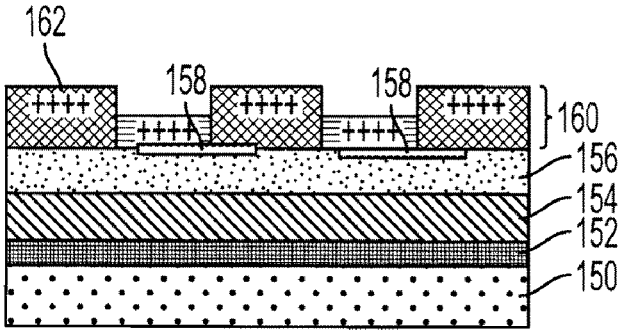
Figure 9D:
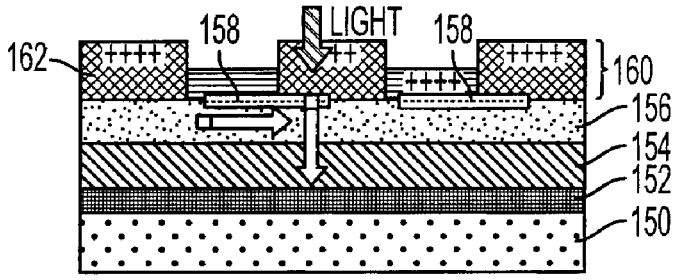

A liquid 166 (in this embodiment sufficiently conductive for relatively rapid discharge, but can be more insulating than many metals and other conductors in this system) is next applied within cells 164, as shown in FIG. 9B, and as described above. The structure including liquid 166 is then charged as shown in FIG. 9C, and as described above. At this point, the conductivity of the charge generation layer may be altered by exposure to light such that individual cells may selectively be discharged, as shown at FIG. 9D. The discharging according to this embodiment occurs by creation of a conduction path between liquid 166 and conductor 152 via shorting electrodes 158. The role of shorting electrodes 158 is thus to facilitate and expedite charge conduction between charged liquid 166 and conductor 152 (which may for example be grounded). Liquid 166 in a cell may thereby be selectively discharged.

Figure 9E:
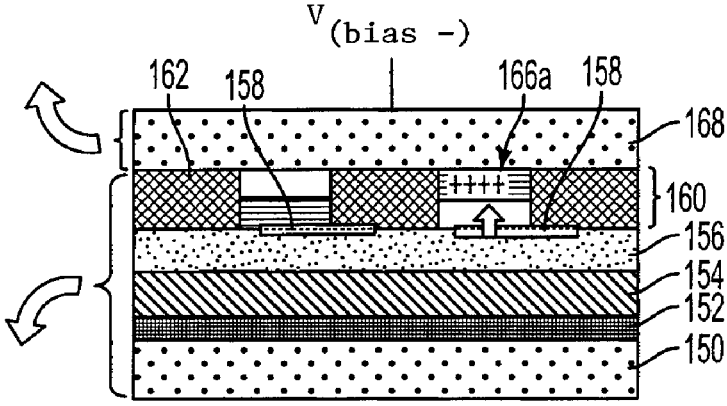
Figure 9F:
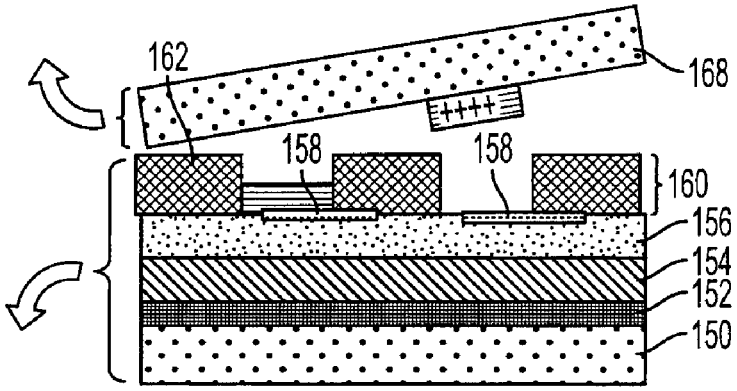

A biased substrate 168 is then applied over the structure and liquid, and the attraction between charged liquid 166*a* and biased substrate 168 causes the liquid 166*a* to become attached to substrate 168, as shown at FIG. 9E. (It will be appreciated that in certain instances of this embodiment the liquid meniscus extends towards and wets the biased substrate 168, and is then electrostatically pulled from the cell. The liquid transfer may also not be complete—some liquid may remain within cell 164 following transfer of the majority of the liquid to substrate 168.) Substrate 168 is removed, as shown at FIG. 9F, and the developed image affixed to substrate 168 as previously described.

Figure 10:
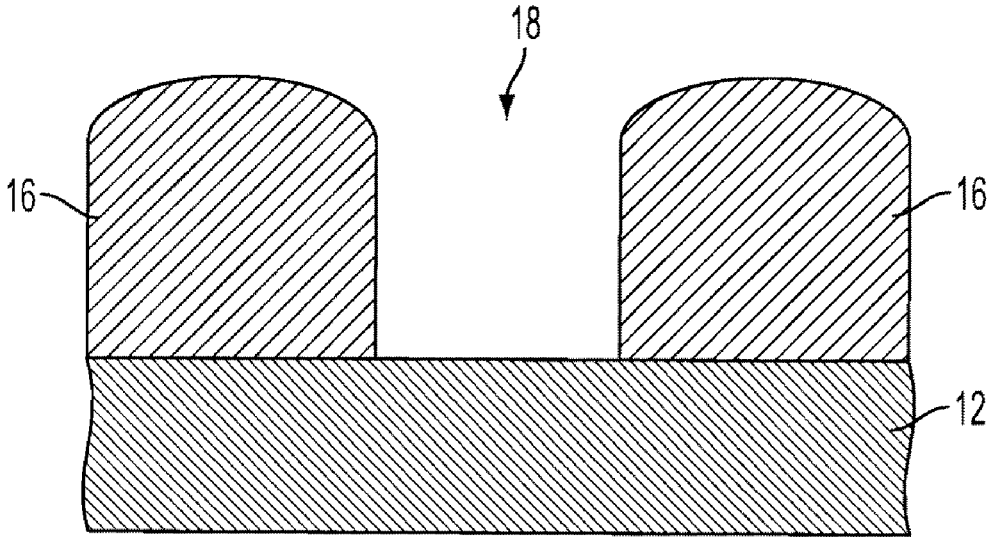
FIG. 10 is a cross section elevation view of a pixilated photoreceptor with rounded isolation lands formed thereon according to an embodiment of the present description.

In one or more of the above embodiments, the lands (16 in FIGS. 1 and 3, 108 in FIGS. 5 and 6, and 162 in FIG. 9) can be rounded to aid metering of liquid therein. Such a rounding of these lands is illustrated in FIG. 10 for lands 16 of FIG. 1 (similar cross-sections would apply to lands 108 in FIGS. 5 and 6, and 162 in FIG. 9).

Furthermore, in one or more of the above embodiments, the cells themselves may be vertically conducting to minimize charge build up. Within each cell there must be sufficient conductivity to discharge the cell. That is, there needs to be sufficient conductivity to the discharging line or conductor. If this discharging conductor is at the bottom of the cell only, as for example illustrated in the embodiment shown and described with regard to FIG. 9, then the ink/liquid may need to be charged such that the bulk is charged. Therefore, in an alternative embodiment of the present disclosure, at least a portion of the sidewalls of cells 164 may be made conductive. An embodiment 180 according to this aspect is shown in FIGS. 11A through 11E.

Figure 11A:
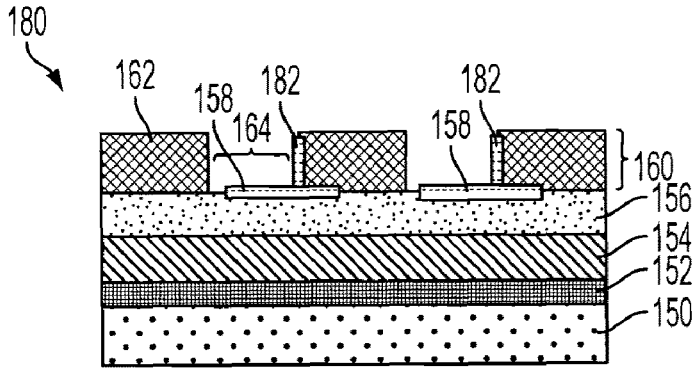
FIGS. 11A through 11F are side elevation views of a pixilated photoreceptor including conductive sidewalls according to one aspect of the present disclosure.
Figure 11B:
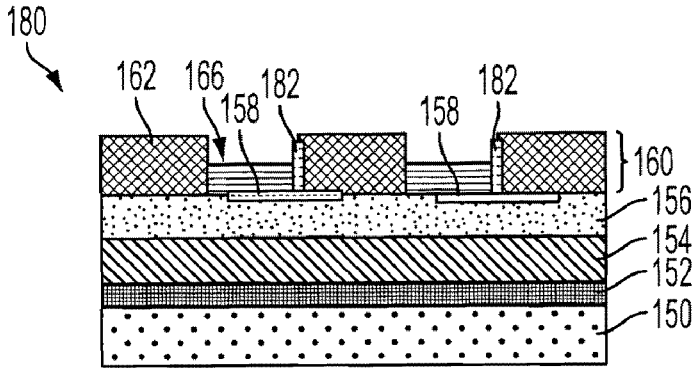
Figure 11C:
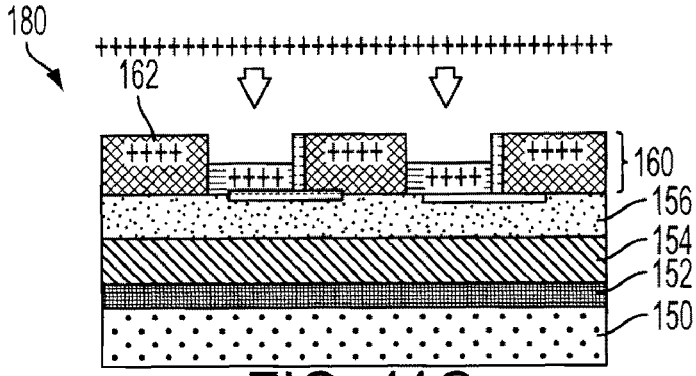
Figure 11D:
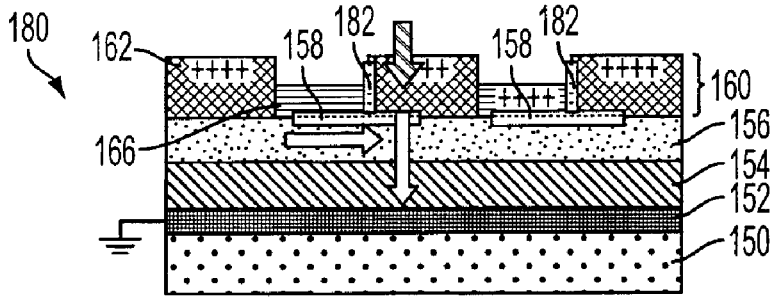
Figure 11E:
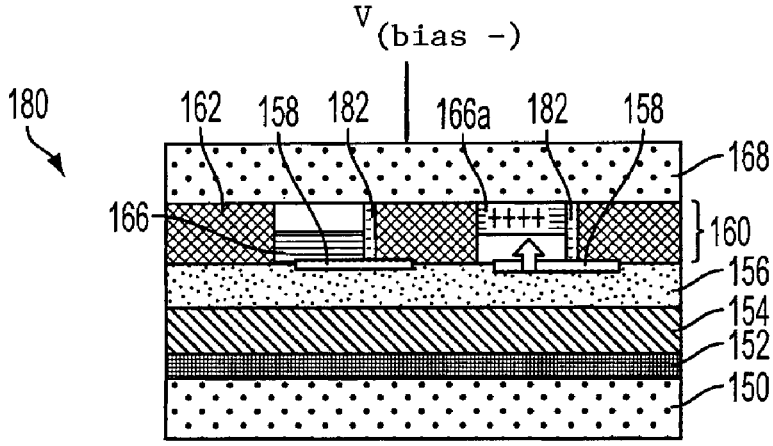
Figure 11F:
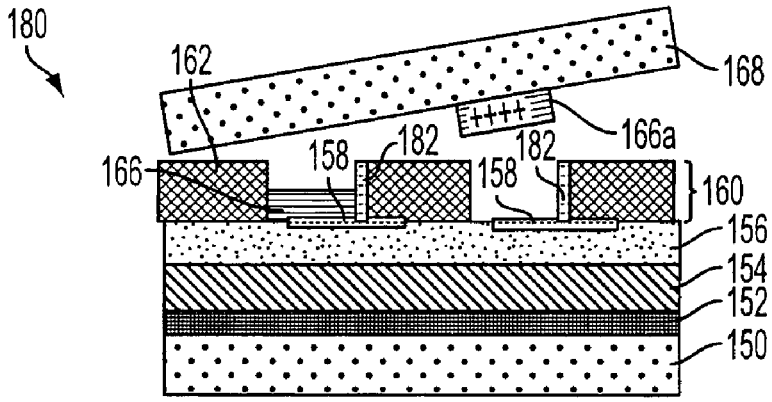

The general structure of this embodiment is shown in FIG. 11A. In addition to the elements previously described, embodiment 180 includes a conductive element 182 disposed on at least a portion of the sidewall of cell 164, which is in electrical contact with shorting electrode 158. FIG. 11B illustrates a conductive liquid surface application material 166 loaded into cells 164. Also shown in FIG. 11B is that the height of conductive element 182 within cell 164 may be (but need not necessarily be) at least equal to the height of liquid 166 within cell 164. One motivation for this height being above the height of the liquid is that if liquid 166 has applied thereto a surface charge (shown in FIG. 11C) as opposed to a bulk charge, conductive element 182 should be in contact with the charged surface of liquid 166. In this way, conductive element 182 becomes a conduction path for selective discharging of a surface charge on the surface of liquid 166. Accordingly, conductive element 182 is connected to a bias (e.g., ground) when discharging of a cell is desired, as shown in FIG. 11D. The transfer and removal processes of FIGS. 11E and 11F, respectively, are thereafter essentially as described above. Thus, sufficient electrical contact may be made between the top surface of liquid 166 and the conductive element 182 on the sidewall of cell 164 to effectively obviate the need for bulk charging of the liquid.

Figure 12:
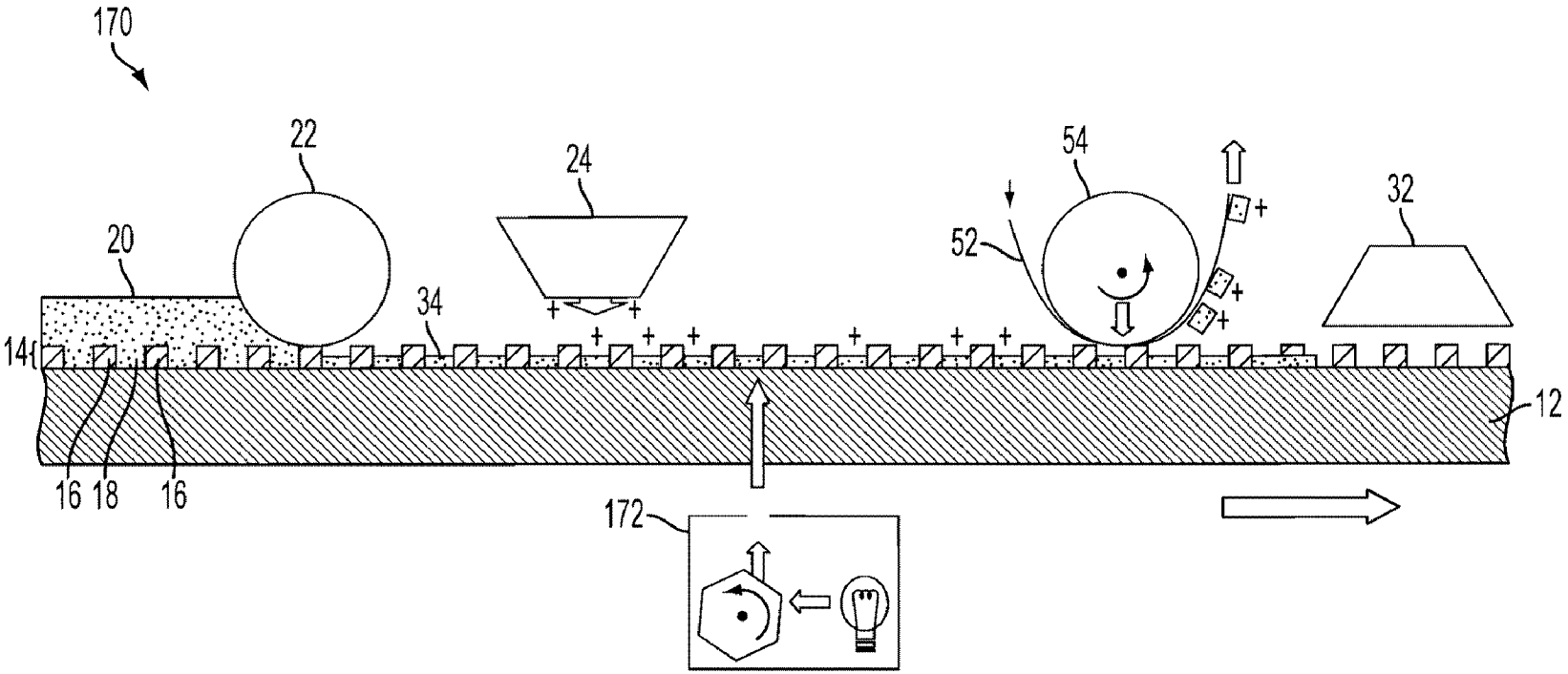
FIG. 12 is a schematic illustration of a system for the printing of viscous liquids using a pixilated photobelt and back-side exposure according to another embodiment of the present disclosure.

In still another embodiment 170 of the present disclosure illustrated in FIG. 12, the photoreceptor may be addressed from the backside thereof. In this embodiment, the photoreceptor carrier (e.g., belt) and the various layers between it and a photocharge generation layer must be optical transparent at the wavelength of the light used to expose the photoreceptor. Optical addressing system 172 may then address individual cells 18, as described above, but in this embodiment from the back side of photobelt 12. This embodiment provides the advantage that the gravure cells (including liquid therein) can now be fully opaque. Furthermore, this embodiment separates optics from the liquid area, providing a cleaner optics region of the system.

Figure 13A:
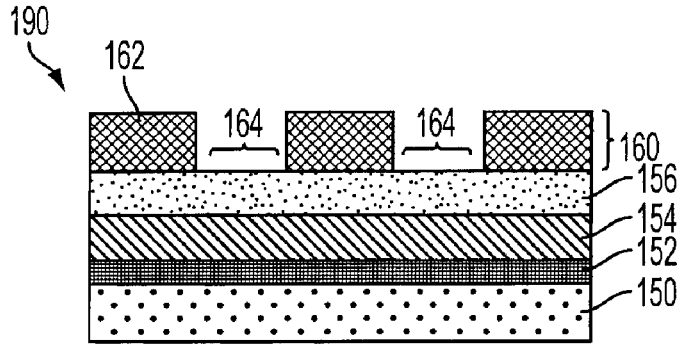
FIGS. 13A through 13E are side elevation views of a pixilated photoreceptor including with back-side charging according to one aspect of the present disclosure.
Figure 13B:
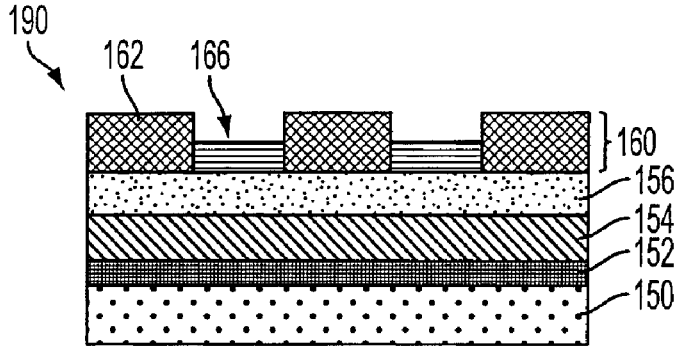
Figure 13C:
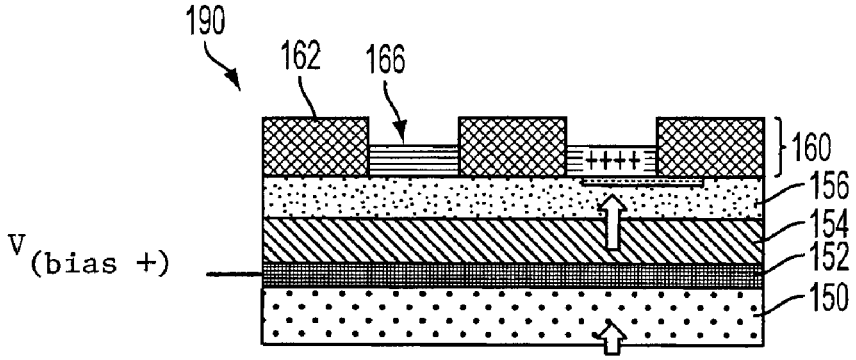
Figure 13D:
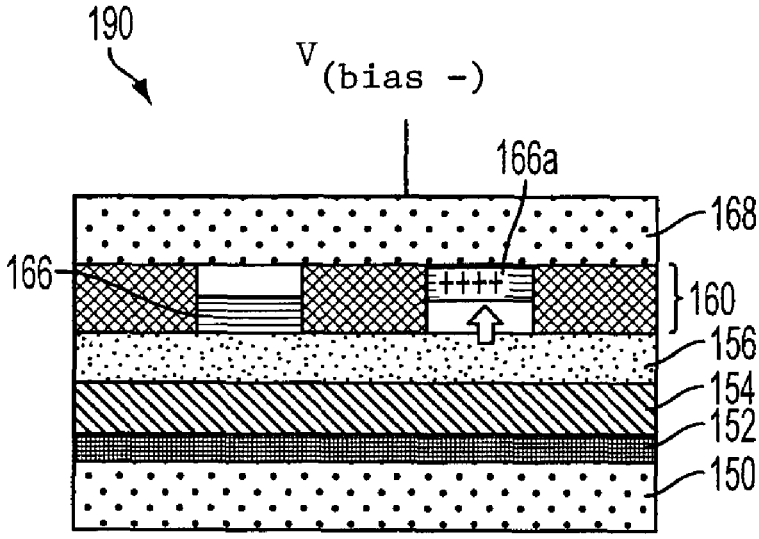
Figure 13E:
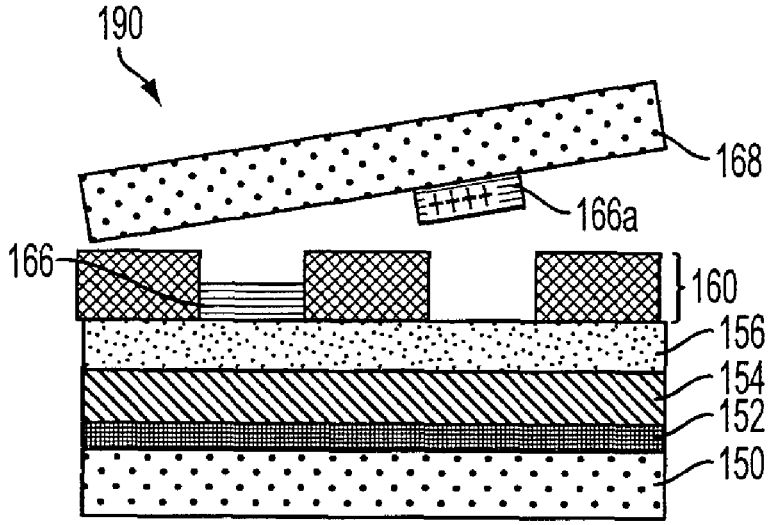

While in the embodiments described above a corona charging device is employed to charge the cells, in other embodiments no corona charging device is needed. One exemplary embodiment 190 is shown with reference to FIGS. 13A-E. The general structure of this embodiment is shown in FIG. 13A. In FIG. 13B, a liquid surface application material 166 is loaded into cells 164. In FIG. 13C, conductor 152 serves as a voltage plane which is electrically isolated from liquid 166 in cells 164. When the optical exposure illuminates the charge generation layer 154 (photoconductor region) connecting conductor 152 to the individual cell being addressed, the charge from conductor 152 locally transfers to liquid 166 within the cell 164, producing charged liquid 166*a*. The transfer and removal processes of FIGS. 13D and 13E, respectively, are thereafter essentially as described above. In this embodiment, spacer layer 160 does not have to be optically transparent. One advantage of this embodiment is that individual cells may be selectively charged. This obviates the need for selective discharging, and effectively reduces a step in the overall process. Another advantage is that the top of the cell walls are not directly charged. If the liquid within the cells are bulk charged, then conductive sidewalls are also not required. If only a surface charge is to utilized for the transfer of liquid 166*a* to the substrate 168, then conductive sidewalls of the type described with reference to FIGS. 11A through 11F may be employed to facilitate surface charging of liquid 166.

In a variation of the above embodiment, the conductor 152 may be selectively illuminated from the same side as the side from which the cells 164 are filled with liquid 166. This is essentially the same configuration as illustrated in FIG. 13, with the light source illuminating the photoreceptor through either the pixilated spacer layer, through the ink, or both. We refer to the embodiment described in the preceding paragraph as back-side illumination, and we refer to the embodiment of this paragraph as front-side illumination.

Finally, in certain embodiments it may be desirable to include both the corona charging and optical charge-transfer addressing. Basically a corona charging unit (such as 24 of FIG. 1) deposits charge on the liquid in all the cells (e.g., a negative charge). The optical addressing (front- or back-side illumination) can both discharge a cell and supply an opposite (e.g., positive) charge to the addressed cells (canceling or overwhelming the previous existing negative charge). Thus, having both the corona charging and the addressed photoreceptor bias allows a much wider range of possible voltages on the liquid to maximize ink transfer while at the same time minimizing background printing (printing from non-image cells).

The physics of modern electromechanical devices and the methods of their production are not absolutes, but rather statistical efforts to produce a desired device and/or result. Even with the utmost of attention being paid to repeatability of processes, the accuracy of manufacturing facilities, the purity of starting and processing materials, and so forth, variations and imperfections result. Accordingly, no limitation in the description of the present disclosure or its claims can or should be read as absolute. The limitations of the claims are intended to define the boundaries of the present disclosure, up to and including those limitations. To further highlight this, the term "substantially" may occasionally be used herein in association with a claim limitation (although consideration for variations and imperfections is not restricted to only those limitations used with that term). While as difficult to precisely define as the limitations of the present disclosure themselves, we intend that this term be interpreted as "to a large extent", "as nearly as practicable", "within technical limitations", and the like.

Furthermore, while a plurality of preferred exemplary embodiments have been presented in the foregoing detailed description, it should be understood that a vast number of variations exist, and these preferred exemplary embodiments are merely representative examples, and are not intended to limit the scope, applicability or configuration of the disclosure in any way. For example, while the above has used a photoreceptor belt as an exemplary embodiment, other forms of photoreceptors may be used depending on the application and other aspects of the implementation of the present disclosure. Furthermore, while a corona charging device has been the main element described above for charging the structure and liquid, an electrode, capacitor or other similar arrangement could be equivalently employed. Again, the elements and interconnection of those elements may vary depending on the application and other aspects of the implementation of the present disclosure. In addition, various of the above-disclosed and other features and functions, or alternative thereof, may be desirably combined into many other different systems or applications. Various presently unforeseen or unanticipated alternatives, modifications variations, or improvements therein or thereon may be subsequently made by those skilled in the art which are also intended to be encompassed by the claims, below.

Therefore, the foregoing description provides those of ordinary skill in the art with a convenient guide for implementation of the disclosure, and contemplates that various changes in the functions and arrangements of the described embodiments may be made without departing from the spirit and scope of the disclosure defined by the claims thereto.

What is claimed is:

1. An apparatus for imparting an image onto a substrate, comprising:

a photoreceptive member whose conductivity may be selectively locally changed by the incidence of light thereon;

an electrically insulative spacer layer formed over said photoreceptive member, said spacer layer comprising a plurality of lands which define a plurality of physically and electrically isolated cells over said photoreceptive member;

a surface application material application mechanism for applying a liquid surface application material over the spacer layer and thereby at least partially fill said cells;

a charging mechanism for applying a charge to liquid surface application material within said cells;

an optical addressing system for individually optically addressing each said cell, said optical addressing system initiating the transfer of charge on said liquid surface application material within any cell which said optical addressing system exposes to light; and a transfer mechanism for selectively substantially transferring either charged or uncharged liquid surface application material from said cells to an image receiving member while substantially not transferring the remainder of the liquid surface application material from said cells to said image receiving member.

2. The apparatus of claim 1, wherein said photoreceptive member is a substantially photoconductive belt comprising:

a carrier member;

a conductive bias layer formed over said carrier member;

a charge generation layer formed over said conductive bias layer; and a charge conduction layer formed over said charge generation layer.

3. The apparatus of claim 2, further comprising a plurality of shorting electrodes formed over said charge conduction layer, at least a portion of each said shorting electrode being exposed within one of said electrically isolated cells, and wherein each said shorting electrode is sized and disposed so as not to be in direct electrical contact with any other shorting electrode.

4. The apparatus of claim 1, wherein said lands define a substantially uniform array of said physically and electrically isolated cells.

5. The apparatus of claim 4 wherein said lands have a convexly rounded surface farthest from said photoreceptive member.

6. The apparatus of claim 1, wherein said optical addressing system is disposed opposite from and on the same surface side of said photoreceptive member as said electrically insulative spacer layer.

7. The apparatus of claim 6, wherein said electrically insulative spacer layer, and hence said lands, are substantially optically transparent at a wavelength of light emitted by said optical addressing system.

8. The apparatus of claim 6, further comprising liquid surface application material disposed in said cells, said liquid surface application material being at least partially optically transparent at a wavelength light emitted by said optical addressing system.

9. The apparatus of claim 8, wherein said liquid surface application material is a liquid ink with a viscosity above 100 cp.

10. The apparatus of claim 8, wherein said liquid surface application material is selected from the group consisting of: toner, ink, adhesive, surface finish treatment, protective coating, and electrically conductive material.

11. The apparatus of claim 1, wherein said optical addressing system is disposed on a side of said photoreceptive member opposite from the side on which said electrically insulative spacer layer is disposed.

12. The apparatus of claim 11, wherein said photoreceptive member is at least partially optically transparent at a wavelength of light emitted by said optical addressing system.

13. The apparatus of claim 11, further comprising liquid surface application material disposed in said cells, said liquid surface application material being a liquid ink with a viscosity above 100 cp.

14. The apparatus of claim 1, wherein said charging mechanism is a corona charging device providing a substantially uniform charge to liquid surface application material within said cells.

15. The apparatus of claim 1, wherein liquid surface material within said cells is selectively charged on a cell-by-cell selection basis.

16. The apparatus of claim 1, wherein said optical addressing system is a raster output scanning system.

17. The apparatus of claim 1, wherein said transfer mechanism is a charged drum disposed such that said image receiving member is disposed between said charged drum and said photoreceptive member, the charge on said drum being opposite that of the charge on said liquid surface application material.

18. The apparatus of claim 1, wherein each said cell comprises a base and a wall structure, said apparatus further comprising, within each said cell, a conductive wall structure comprising an electrically conductive surface extending from said base of said cell at least partway up said wall structure.

19. The apparatus of claim 18, further comprising liquid surface application material disposed in each said cells to a material depth, and further wherein each said conductive wall structure extends from said base of said cell to at least the material depth.

20. The apparatus of claim 2, wherein said belt travels in a process direction, said apparatus further comprising a cleaning mechanism for removing any remaining liquid surface application material from said cells and said lands at a position after a point of transfer of liquid surface application material to said image receiving member in said process direction.

21. The apparatus of claim 20, wherein said image receiving member is paper, said apparatus further comprising a paper handling mechanism providing paper to said point of transfer of liquid surface application material thereto, a fixing mechanism for fixing said liquid surface application material to said paper to form a lasting image thereon, and an outfeed mechanism for receiving and handling the paper having said lasting image thereon.

22. An apparatus for imparting an image onto a substrate, comprising:

a photoconductive belt, comprising:

a carrier member;

a conductive biasing layer formed over said carrier member; and a photoconductor layer formed over said conductive biasing layer;

an electrically insulative spacer layer formed over said photoconductive belt, said spacer layer comprising a plurality of lands which define a plurality of physically and electrically isolated cells formed in a substantially uniform array over said photoconductive belt;

an ink application mechanism for applying a chargeable ink over the spacer layer and thereby at least partially fill said cells;

a charging mechanism for applying a substantially uniform charge to said ink;

an optical addressing system, disposed opposite from and on the same surface side of said photoconductive belt as said electrically insulative layer, for individually optically addressing each said cell, said optical addressing system initiating a charge generation in said photoconductor layer which results in the transfer of charge on said ink within any cell which said optical addressing system exposes to light; and a charged drum for selectively substantially transferring either charged or uncharged ink from said cells to a substrate while substantially not transferring the remainder of the ink from said cells to said substrate, disposed such that said substrate is disposed between said charged drum and said photoconductive belt, the charge on said drum being opposite that of the charge on said ink.

23. The apparatus of claim 22, further comprising ink disposed in said cells, said ink being at least partially optically transparent at a wavelength light emitted by said optical addressing system, and further wherein said ink has a viscosity above 100 cp.

24. The apparatus of claim 22, wherein said electrically insulative spacer layer is at least partially transparent at a wavelength of light output by said optical addressing system.

25. A method of imparting an image onto a substrate, comprising:

at least partially filling cells of a pixilated photoreceptor with chargeable liquid surface application material;

applying a substantially uniform charge to said liquid surface application material in said cells;

exposing selected regions of said pixilated photoreceptor below said cells containing charged liquid surface application material with light such that said regions are made electrically conductive and further such that the charge on the liquid surface application material in said cells above said conductive regions is transferred while not exposing other selected regions of said pixilated photoreceptor below said cells such that said regions remain non-conductive and further such that the charge on the liquid surface application material in said cells above said non-conductive regions is not transferred and said liquid surface application material in said cells above said non-conductive regions remains substantially charged;

positioning an image receiving member in a region proximate said cells and biasing said member such that either charged or uncharged liquid surface application material in said cells is transferred to said image receiving member while the remainder of the liquid surface application material in said cells remains in said cells; and separating said image receiving member from said cells such that said liquid surface application material that has been transferred to said image receiving member remains affixed to said image receiving member substantially where transferred.

26. The method of claim 25, further comprising:

following separating said image receiving member from said cells, removing any remaining surface application material from said cells; and discharging any remaining charge in said cells in preparation for repeating the filling, charging, exposing, and transferring of said liquid surface application material to said image receiving member.

27. The method of claim 25, wherein said cells of said pixilated photoreceptor are formed in an insulating, at least partially transparent layer, and further wherein said selected regions of said pixilated photoreceptor are exposed from the same side as a side from which said cells are filled with said charged liquid surface application material, said exposure occurring partially through each of said insulating, at least partially transparent layer and said liquid surface application material in said cells.

28. The method of claim 25, wherein said pixilated photoreceptor comprises an at least partially transparent carrier, and further wherein said selected regions of said pixilated photoreceptor are exposed from a side opposite a side from which said cells are filled with said charged liquid surface application material, said exposure occurring through said carrier.

29. The method of claim 25, wherein said liquid surface application material is selected from the group consisting of: toner, ink, adhesive, surface finish treatment, protective coating, and electrically conductive material.

* * * * *